US011567429B2

(12) United States Patent
Kato et al.

(10) Patent No.: US 11,567,429 B2
(45) Date of Patent: Jan. 31, 2023

(54) DEVELOPING DEVICE AND IMAGE FORMING APPARATUS WITH SEPARATELY DRIVEN ELEMENTS

(71) Applicant: FUJIFILM Business Innovation Corp., Tokyo (JP)

(72) Inventors: Masanori Kato, Kanagawa (JP); Katsumi Yamada, Kanagawa (JP); Shota Igawa, Kanagawa (JP); Yoshihisa Nakao, Kanagawa (JP); Atsushi Funada, Kanagawa (JP); Mitsutoshi Hongo, Kanagawa (JP); Makoto Kanno, Kanagawa (JP); Daisuke Uchimitsu, Kanagawa (JP); Yoshitaka Nakajima, Kanagawa (JP); Sadayuki Tsujino, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/409,914

(22) Filed: Aug. 24, 2021

(65) Prior Publication Data

US 2022/0373927 A1 Nov. 24, 2022

(30) Foreign Application Priority Data

May 20, 2021 (JP) ..... JP2021-085639

(51) Int. Cl.
*G03G 15/08* (2006.01)

(52) U.S. Cl.
CPC ..... *G03G 15/0887* (2013.01)

(58) Field of Classification Search
CPC ..... G03G 15/0887
See application file for complete search history.

(56) References Cited

FOREIGN PATENT DOCUMENTS

JP 2009-175768 A 8/2009
JP 5483088 B2 * 5/2014

OTHER PUBLICATIONS

English machine translation of Tsuda et al. (JP 5483088 B2) (Year: 2014).*

* cited by examiner

*Primary Examiner* — Walter L Lindsay, Jr.
*Assistant Examiner* — Geoffrey T Evans
(74) *Attorney, Agent, or Firm* — Sughrue Mion, PLLC

(57) ABSTRACT

A developing device includes a first transport member and a second transport member that are respectively disposed in a first transport path and a second transport path arranged in a vertical direction and that transport developer so as to circulate the developer between the first transport path and the second transport path; a developing member that is disposed to face the first transport path and that receives the developer from the first transport path; and a driving device that operates such that a relative speed ratio between a rotational speed of the developing member and a rotational speed of the second transport member is changeable.

17 Claims, 10 Drawing Sheets

DEVELOPING DEVICE AND IMAGE FORMING APPARATUS WITH SEPARATELY DRIVEN ELEMENTS

CROSS-REFERENCE TO RELATED APPLICATIONS

This application is based on and claims priority under 35 USC 119 from Japanese Patent Application No. 2021-085639 filed May 20, 2021.

BACKGROUND

(i) Technical Field

The present disclosure relates to a developing device and an image forming apparatus.

(ii) Related Art

Japanese Unexamined Patent Application Publication No. 2009-175768 discloses a developing device including a developing roller, a developing container, a first stirring member, a second stirring member, and a communication passage. The developing roller transports toner to a developing region in which an electrostatic latent image is developed into a toner image. The developing container includes a developing-roller accommodation portion that accommodates the developing roller; a first stirring chamber disposed diagonally below the developing-roller accommodation portion; and a second stirring chamber disposed adjacent to the developing-roller accommodation portion and above the first stirring chamber. The first stirring member is accommodated in the first stirring chamber and transports the toner in the first stirring chamber in a predetermined first transporting direction while stirring the toner. The second stirring member is accommodated in the second stirring chamber and transports the toner in the second stirring chamber in a second transporting direction that is opposite to the first transporting direction while stirring the toner. The communication passage connects a downstream end portion of the first stirring chamber in the first transporting direction to an upstream end portion of the second stirring chamber in the second transporting direction so that the toner is transported from the downstream end portion of the first stirring chamber in the first transporting direction to the upstream end portion of the second stirring chamber in the second transporting direction. A portion of the communication passage is disposed vertically below an axis of the developing roller, the portion being farther from the developing roller with respect to a rotational axis of the first stirring member and closest to the developing roller on a surface of the communication passage that is in contact with the second stirring chamber. The developing device further includes an accumulated-developer transport member for stirring and transporting developer that accumulates between the developing roller and the first stirring member.

SUMMARY

Aspects of non-limiting embodiments of the present disclosure relate to a developing device that includes a first transport member and a second transport member arranged adjacent to each other in a vertical direction and that is capable of more reliably supplying developer to a developing member as necessary compared to a case where the first developing member and the second transport member are rotated at a constant rotational speed ratio.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device including a first transport member and a second transport member that are respectively disposed in a first transport path and a second transport path arranged in a vertical direction and that transport developer so as to circulate the developer between the first transport path and the second transport path; a developing member that is disposed to face the first transport path and that receives the developer from the first transport path; and a driving device that operates such that a relative speed ratio between a rotational speed of the developing member and a rotational speed of the second transport member is changeable.

BRIEF DESCRIPTION OF THE DRAWINGS

An exemplary embodiment of the present disclosure will be described in detail based on the following figures, wherein.

DETAILED DESCRIPTION

Figure 1:
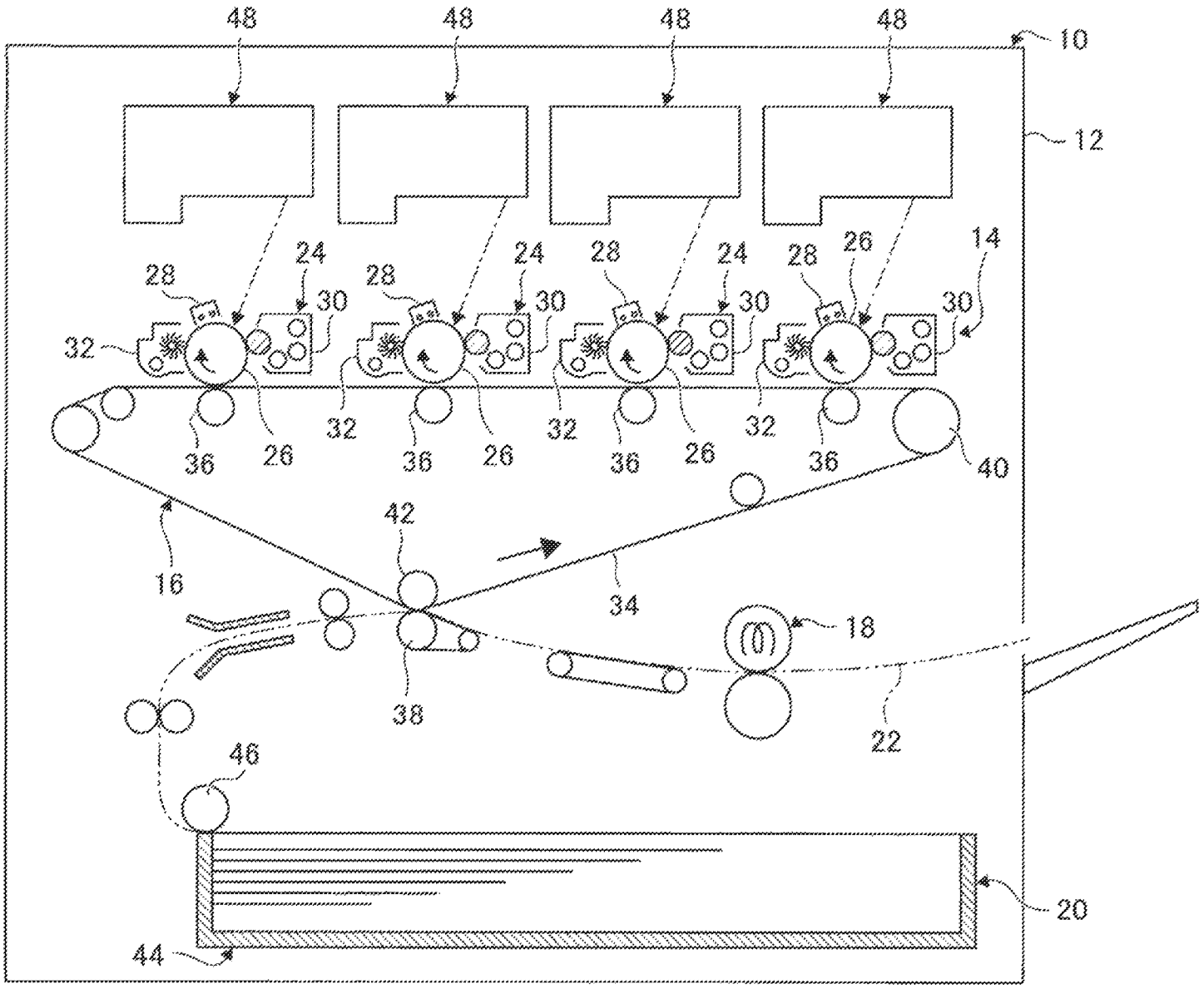
FIG. 1 is a side view illustrating the structure of an image forming apparatus according to an exemplary embodiment of the present disclosure.

An exemplary embodiment of the present disclosure will now be described with reference to the drawings. FIG. 1 illustrates an image forming apparatus 10 according to the exemplary embodiment of the present disclosure. The image forming apparatus 10 includes an image-forming-apparatus body 12. An image forming unit 14, a transfer device 16, a fixing device 18, and a sheet feeding device 20 are disposed in the image-forming-apparatus body 12. A recording-medium transport path 22 along which a recording medium, such as a paper sheet, is transported is also disposed in the image-forming-apparatus body 12.

The image forming unit 14 employs an electrophotographic system, and forms an image on the recording medium. The image forming unit 14 includes, for example, plural image forming units 24, for example, four image forming units 24. The four image forming units 24 form toner images of different colors, for example, yellow, magenta, cyan, and black.

Each image forming unit 24 includes a photoconductor drum 26. The photoconductor drum 26, which is an example of an image carrier, rotates while carrying a toner image to be transferred to the recording medium on an outer peripheral surface thereof. Each image forming unit 24 also includes a charging device 28 that charges the photoconductor drum 26; a developing device 30 that develops a charged latent image with developer; and a cleaning device 32 that cleans the photoconductor drum 26 after a transferring process. Optical writing devices 48 are provided to form latent images on respective ones of the charged photoconductor drums 26.

The transfer device 16 includes an intermediate transfer belt 34. Toner images are transferred from the photoconductor drums 26 to the intermediate transfer belt 34 by first transfer members 36 in a first transfer process, and then are transferred to the recording medium by a second transfer member 38 in a second transfer process.

The intermediate transfer belt 34 is rotatably supported by plural support members 40. A back-up member 42 faces the second transfer member 38.

The fixing device 18 fixes the toner images that have been transferred to the recording medium to the recording medium by using, for example, heat and pressure.

The sheet feeding device 20 includes a storage unit 44 in which a stack of recording media is stored and a feeding member 46 that feeds the recording media stored in the storage unit 44 toward the recording-medium transport path 22.

The recording-medium transport path 22 transports each recording medium from the sheet feeding device 20 to the position between the second transfer member 38 and the back-up member 42, further transports the recording medium to the fixing device 18, and still further transports the recording medium so that the recording medium is output to the outside of the image-forming-apparatus body 12.

In the image forming apparatus 10 having the above-described structure, the toner images formed on the outer peripheral surfaces of the photoconductor drums 26 are transferred to the intermediate transfer belt 34 in the first transfer process. The toner images that have been transferred to the intermediate transfer belt 34 in the first transfer process are transferred to the recording medium in the second transfer process. The toner images that have been transferred to the recording medium in the second transfer process are fixed to the recording medium by the fixing device 18.

The developing device 30 according to the present exemplary embodiment will now be described with reference to FIG. 2. The developing device 30 is a two-component developing device that stirs developer, which contains carrier and toner, to charge the toner in a developing process. In the following description, a vertically upward direction, which is the direction opposite to the direction of gravity, is referred to as upward, and a vertically downward direction, which is the direction of gravity, is referred to as downward. The vertically upward and downward directions are generically referred to simply as a vertical direction, or an up-down direction, when they are not distinguished from each other. A direction that is orthogonal to the vertical direction and in which a developing roller 52, a first transport member 82, and a second transport member 84, which will be described below, extend is referred to as an axial direction. For convenience, an end at which a developer supply port 70 of a first transport path 62, which will be described below, is located, that is, the left end in FIG. 3, is referred to as a supply end, and an end at which a lower discharge port 80 of a second transport path 64, which will be described below, is located, that is, the right end in FIG. 3, is referred to as a discharge end.

The developing device 30 faces the photoconductor drum 26, which serves as an image carrier. The developing device 30 includes a developing-device body 50 shaped in the form of a developing-device housing. The developing-device body 50 houses the developing roller 52, which faces the photoconductor drum 26 and serves as a developing member. The developing roller 52 includes a magnet roller 54 that forms a magnetic field that is uniform in the axial direction, and a developing sleeve 56 that is rotatably attached to an outer periphery of the magnet roller 54. The magnet roller 54 is disposed in the developing sleeve 56 and fixed to the developing-device body 50. The developing sleeve 56 is supported by a cylindrical member made of a non-magnetic material such that the developing sleeve 56 is rotatable with respect to the developing-device body 50. A layer-thickness-regulating member 58 is fixed to the developing-device body 50 at a location above the developing roller 52. The layer-thickness-regulating member 58 faces the developing sleeve 56 and regulates the thickness of a developer layer. The layer-thickness-regulating member 58 is composed of a metal plate. The layer-thickness-regulating member 58 regulates the thickness of a layer of toner that has adhered to the periphery of the developing sleeve 56, and then the toner is transferred to a latent image formed on the photoconductor drum 26.

The interior space of the developing-device body 50 is partitioned in the vertical direction by a partition wall 60, so that the first transport path 62 and the second transport path 64 are arranged in the vertical direction. An upper surface of the partition wall 60, which is arc-shaped in cross section, defines a lower surface of the first transport path 62. A lower surface of the partition wall 60, which is also arc-shaped in cross section, defines an upper surface of the second transport path 64. The first transport path 62 and the second transport path 64 have equal lengths in the axial direction, and extend in the axial direction. The developing roller 52 faces a developer feed port 66, which is formed in the first transport path 62 and extends in the axial direction, and receives the developer from the first transport path 62.

Figure 3:
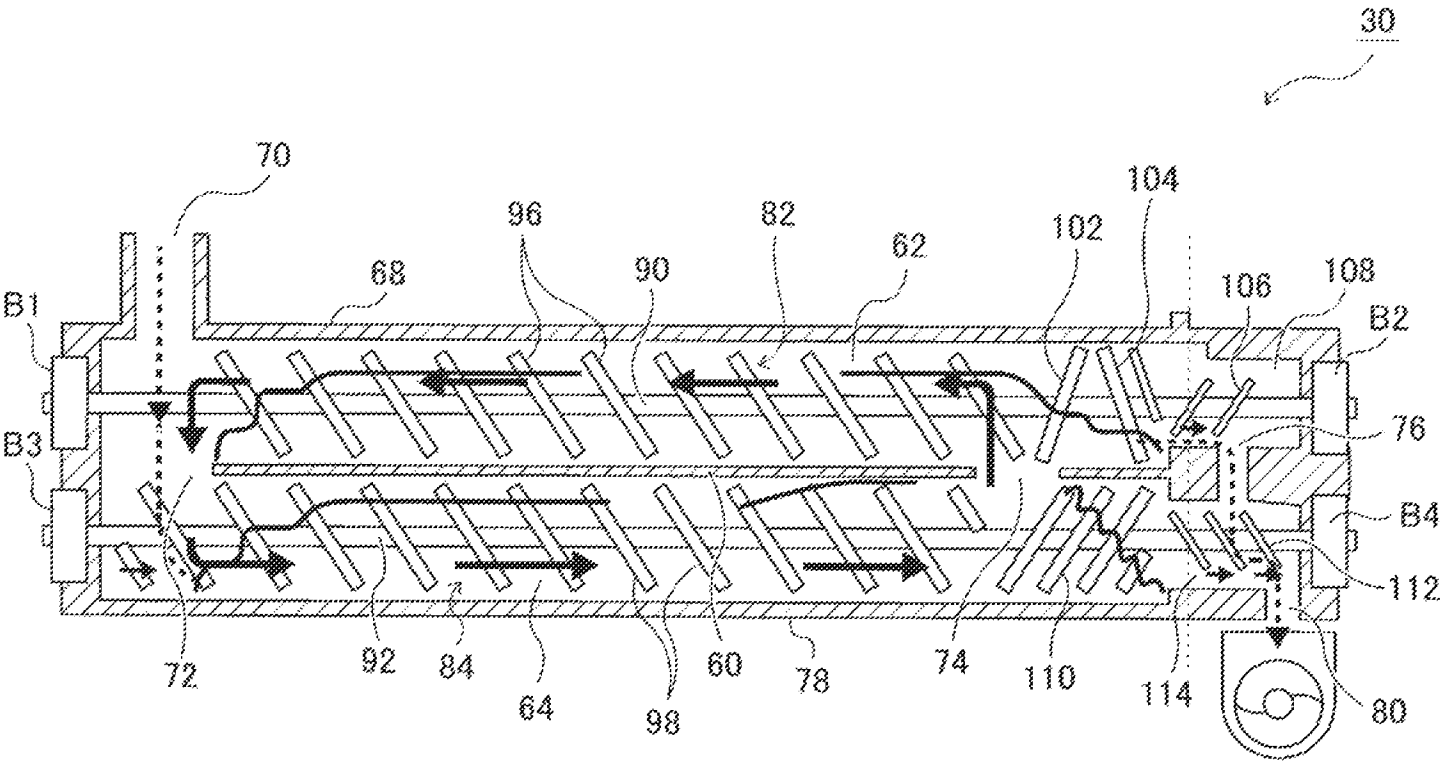
FIG. 3 is a sectional view of the developing device according to the exemplary embodiment of the present disclosure viewed from the front.

As illustrated in FIG. 3, an upper surface 68 of the developing-device body 50, which is also an upper surface of the first transport path 62, has the developer supply port 70 at a position adjacent to the supply end in a region corresponding to an upper portion of the first transport path 62. The partition wall 60 has a first communication port 72 at a position vertically below the developer supply port 70. The partition wall 60 also has a second communication port 74 at a position closer to the discharge end than the first communication port 72 is. The partition wall 60 also has an upper discharge port 76 at a position close to the discharge end. A bottom surface 78 of the developing-device body 50, which is also a bottom surface of the second transport path 64, has the lower discharge port 80 at a position closest to the discharge end.

A first transport member 82 and a second transport member 84 are rotatably disposed in the first transport path 62 and the second transport path 64, respectively. The first transport member 82 and the second transport member 84 stir and transport the developer between the first transport path 62 and the second transport path 64 so that the developer is circulated.

Figure 2:
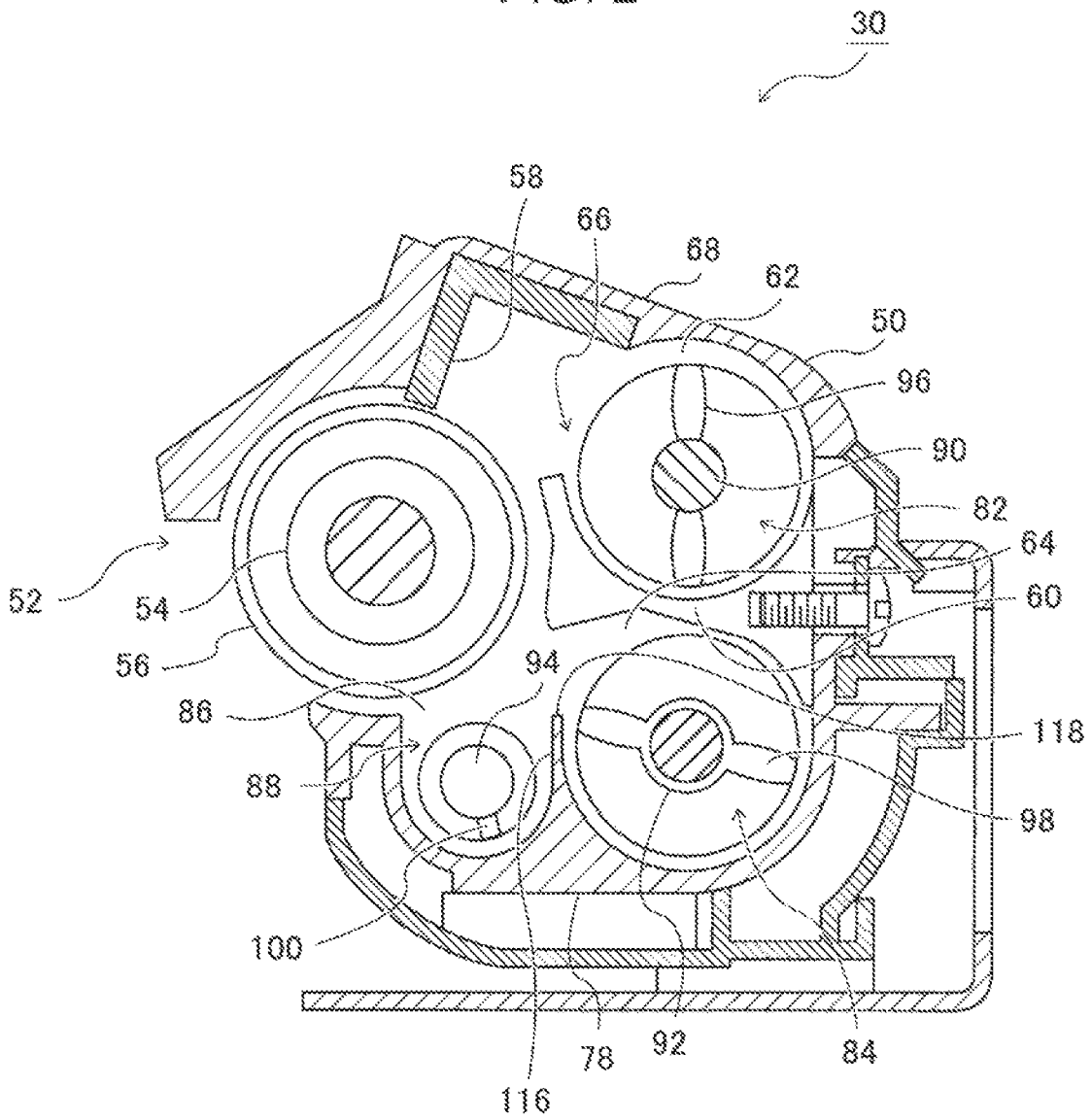
FIG. 2 is a sectional view of a developing device according to the exemplary embodiment of the present disclosure viewed in a direction in which the developing device extends.

As illustrated in FIG. 2, a third transport path 86 is disposed diagonally below the developing roller 52 in the vertical direction. The third transport path 86 is provided to return excess developer from the developing roller 52 to the second transport path 64 so that the excess developer is collected and transported. A third transport member 88 is rotatably disposed in the third transport path 86.

Referring to FIG. 3, the first transport member 82, the second transport member 84, and the third transport member 88 respectively include central shafts 90, 92, and 94. A supply-end portion of the central shaft 90 of the first transport member 82 is supported by a first upper bearing B1 on a supply-end portion of the developing-device body 50 in an upper region thereof, and a discharge-end portion of the central shaft 90 of the first transport member 82 is supported by a second upper bearing B2 on a discharge-end portion of the developing-device body 50 in an upper region thereof. Similarly, a supply-end portion of the central shaft 92 of the second transport member 84 is supported by a first lower bearing B3 on the supply-end portion of the developing-device body 50 in a lower region thereof, and a discharge-end portion of the central shaft 92 of the second transport member 84 is supported by a second lower bearing B4 on the discharge-end portion of the developing-device body 50 in a lower region thereof. The second upper bearing B2 that supports the discharge-end portion of central shaft 90 of the first transport member 82 and the second lower bearing B4 that supports the discharge-end portion of the central shaft 92 of the second transport member 84 are at the same position in the axial direction.

The first transport member 82, the second transport member 84, and the third transport member 88 respectively include transport blades 96, 98, and 100 that extend helically around the central shafts 90, 92, and 94, respectively, and that are inclined in the same direction.

The transport blade 96 of the first transport member 82 is formed around the central shaft 90 in a region between the first communication port 72 and the second communication port 74. The transport blade 98 of the second transport member 84 is also formed around the central shaft 92 in the region between the first communication port 72 and the second communication port 74.

The first transport member 82 also includes a discharge transport blade 102, an adjustment blade 104, and an upper discharge blade 106 in a region between the second communication port 74 and the upper discharge port 76. The discharge transport blade 102 is inclined in a direction opposite to the direction in which the transport blade 96 is inclined. The adjustment blade 104 is inclined in the same direction as the direction in which the transport blade 96 is inclined. The upper discharge blade 106 is inclined in the same direction as the direction in which the discharge transport blade 102 is inclined, and has a radial length less than that of the discharge transport blade 102. The discharge transport blade 102 is formed such that a portion thereof overlaps the second communication port 74. The upper discharge blade 106 is disposed in an upper discharge space 108 that is defined between an upwardly projecting portion of the partition wall 60 and a downwardly projecting portion of the upper surface of the first transport path 62 and that has dimensions smaller than those of the first transport path 62 in the up-down direction and the width direction.

The second transport member 84 also includes a developer returning blade 110 and a lower discharge blade 112 in a region between the second communication port 74 and the lower discharge port 80. The developer returning blade 110 is inclined in a direction opposite to the direction in which the transport blade 98 is inclined. The lower discharge blade 112 is inclined in the same direction as the direction in which the transport blade 98 is inclined. The lower discharge blade 112 is disposed in a lower discharge space 114 that is defined between a downwardly projecting portion of the partition wall 60 and an upwardly projecting portion of the bottom surface of the second transport path 64 and that has dimensions smaller than those of the second transport path 64 in the up-down direction and the width direction.

According to the above-described structure, the developer supplied through the developer supply port 70 falls vertically downward through the first transport path 62, and is supplied to the second transport path 64 through the first communication port 72. The developer is transported through the second transport path 64 by the second transport member 84 in a direction toward the discharge end to a position below and near the second communication port 74. The developer transported to the position below and near the second communication port 74 is prevented from being transported further in the direction toward the discharge end by the developer returning blade 110, and is pressed against the developer transported through the second transport path 64 from the supply end. As a result, the developer at the position below and near the second communication port 74 is pushed vertically upward and fed into the first transport path 62 through the second communication port 74.

The developer fed into the first transport path 62 is supplied to the developing roller 52 through the developer feed port 66 while being transported by the transport blade 96 of the first transport member 82 toward the first communication port 72, that is, in a direction toward the supply end. The developer that has not been supplied to the developing roller 52 and remained in the first transport path 62 is transported by the first transport member 82 to the first communication port 72 in the direction toward the supply end. Then, the developer falls vertically downward through the first communication port 72, and is re-supplied to the second transport path 64 and repeatedly circulated in the above-described manner.

A portion of the developer fed into the first transport path 62 from the second transport path 64 through the second communication port 74 is transported in the direction toward the discharge end by the discharge transport blade 102, and then is partly pushed back toward the supply end by the adjustment blade 104 to prevent discharge of an amount of developer greater than or equal to a predetermined amount. Excess developer that has not been pushed back toward the supply end by the adjustment blade 104 is transported through the upper discharge space 108 by the upper discharge blade 106 in the direction toward the discharge end, and falls vertically downward through the upper discharge port 76, thereby being discharged into the lower discharge space 114 of the second transport path 64. The excess developer that has been discharged into the lower discharge space 114 is transported by the lower discharge blade 112 further in the direction toward the discharge end, and is finally discharged to the outside of the developing-device body 50 through the lower discharge port 80.

Thus, the upper discharge port 76, the lower discharge port 80, the discharge transport blade 102, the adjustment blade 104, the upper discharge blade 106, the upper discharge space 108, and the lower discharge blade 112 form a developer discharging structure that discharges the excess developer discharged from the first transport path 62 to the outside through the second transport path 64.

A portion of the developer supplied to the developing roller 52 from the first transport path 62 remains unused after the developing process. The unused developer is separated from the developing roller 52 toward the third transport path 86, collected and transported into the second transport path 64 from the third transport path 86, and is mixed and stirred by the second transport member 84 together with new developer supplied from a developer supply device (not illustrated). Then, as shown by the arrows in FIG. 3, the developer is pushed upward into the first transport path 62 through the second communication port 74 at the discharge end of the developing-device body 50, and supplied to the developing roller 52 by the first transport member 82 again.

The positional relationship between the developing roller 52, the second transport member 84, and the third transport member 88 will now be described. As illustrated in FIG. 2, the central shaft 92 of the second transport member 84 is disposed farther in the vertically upward direction than is the central shaft 94 of the third transport member 88. The central shaft 92 of the second transport member 84 and the central shaft 94 of the third transport member 88 are both disposed farther in the vertically downward direction than is the central shaft of the developing roller 52. The central shaft 90 of the first transport member 82 is disposed farther in the vertically upward direction than is the central shaft of the developing roller 52.

Since the diameter of the third transport member 88 is less than the diameter of the second transport member 84, the positional relationship between the bottom surface 78 of the second transport path 64 and the bottom surface of the third transport path 86 is such that the bottom surface of the second transport path 64 is at substantially the same height as or slightly higher or lower than the bottom surface of the third transport path 86 in the vertical direction. In the present exemplary embodiment, the central shaft 92 of the second transport member 84 is disposed farther in the vertically upward direction than is the central shaft 94 of the third transport member 88. However, as long as the diameter of the second transport member 84 and the diameter of the third transport member 88 are appropriately selected so that the bottom surface of the second transport path 64 and the bottom surface of the third transport path 86 are at the same or similar heights, the central shaft 92 of the second transport member 84 may instead be disposed at the same height as or slightly below the central shaft 94 of the third transport member 88 in the vertical direction.

A partitioning member 116 having a predetermined height is disposed between the second transport path 64 and the third transport path 86. The partitioning member 116 is a plate-shaped wall that projects vertically upward from a location between the bottom surface of the second transport path 64 and the bottom surface of the third transport path 86, and extends in the axial direction. An upper end 118 of the partitioning member 116 is positioned farther in the vertically upward direction than is an imaginary straight line connecting the central shaft 92 of the second transport member 84 and the central shaft 94 of the third transport member 88. The partitioning member 116 may have any height in the vertical direction, provided that the developer may be transported from the third transport path 86 to the second transport path 64 by the third transport member 88 and that the developer transported from the third transport path 86 to the second transport path 64 is prevented from returning to the third transport path 86.

The partitioning member 116 between the second transport path 64 and the third transport path 86 may be any member having the function of a return prevention member that allows the developer to be transported from the third transport path 86 to the second transport path 64 by the third transport member 88 but prevents or stops the developer transported from the third transport path 86 to the second transport path 64 from returning to the third transport path 86. For example, the partitioning member 116 may be a plate having a free end at the top in the vertical direction or have an opening formed therein as long as the partitioning member 116 allows the developer to flow in one direction.

A method for driving the developing roller 52, the first transport member 82, the second transport member 84, and the third transport member 88 of the developing device 30 having the above-described structure will now be described with reference to FIGS. 4A and 4B. Referring to FIG. 4A, the developing device 30 includes a driving device 120 that drives the developing roller 52 and the second transport member 84 such that a relative speed ratio between a rotational speed of the developing roller 52 and a rotational speed of the second transport member 84 is changeable. The driving device 120 at least drives the developing roller 52 and the second transport member 84 by using different power sources, and includes a first power source M1 and a second power source M2. The developing roller 52 is driven by the first power source M1, and the second transport member 84 is driven by the second power source M2.

The first power source M1 and the second power source M2, which are independent of each other, respectively drive the developing roller 52 and the second transport member 84 such that the rotational speed of the developing roller 52 and the rotational speed of the second transport member 84 are changeable independently of each other.

Figure 4B:
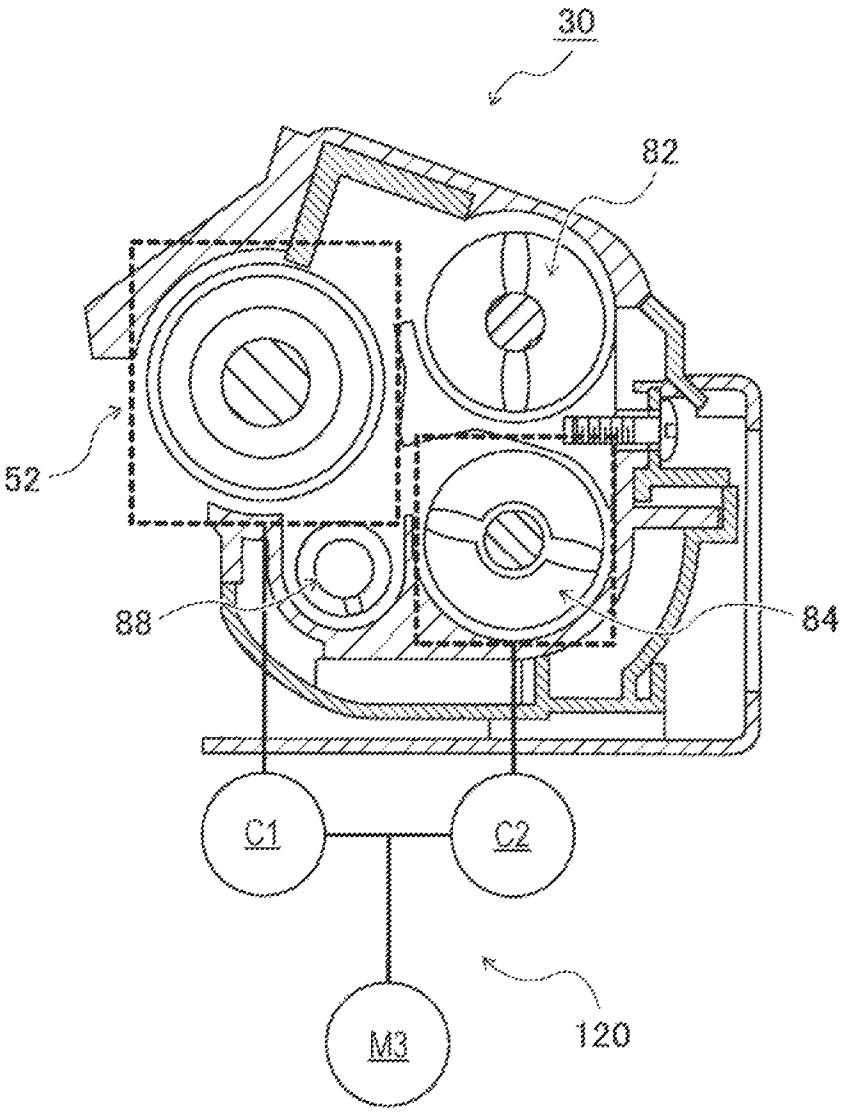
FIG. 4B illustrates another example of a method for driving the developing device according to the exemplary embodiment of the present disclosure.
Figure 4A:
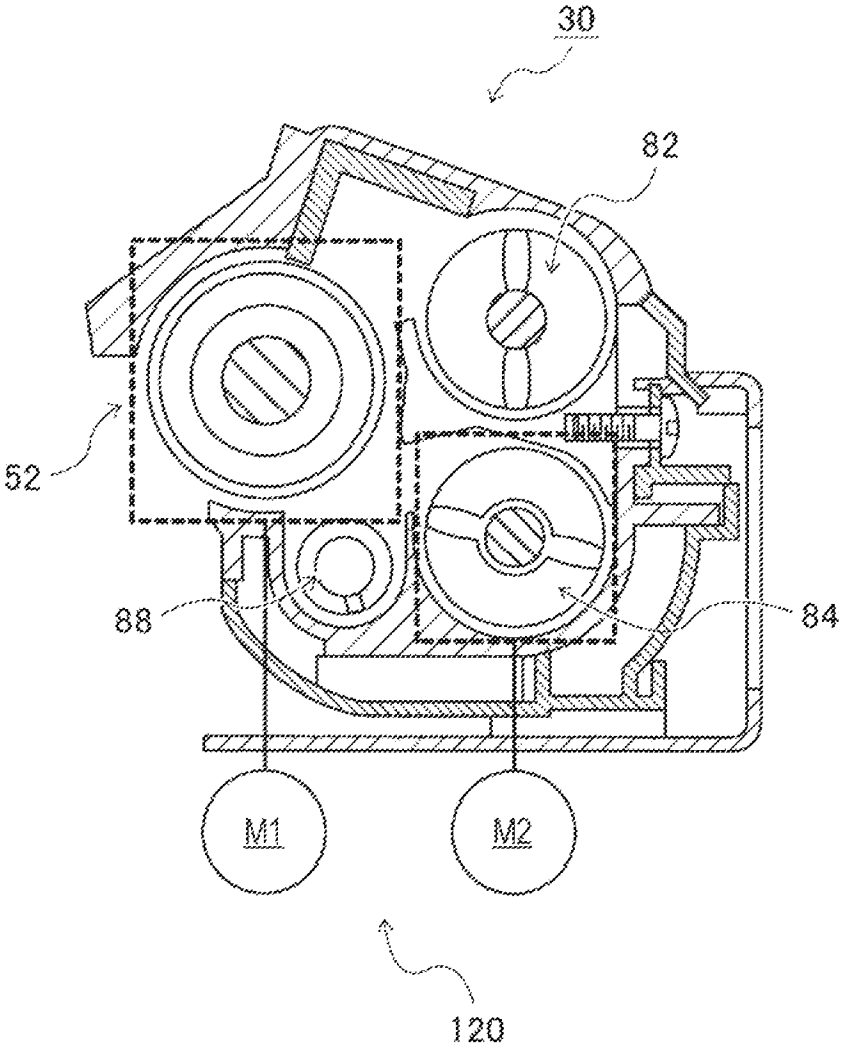
FIG. 4A illustrates an example of a method for driving the developing device according to the exemplary embodiment of the present disclosure.

As illustrated in FIG. 4B, the driving device 120 may instead include clutch mechanisms C1 and C2. In FIG. 4B, the developing roller 52 and the second transport member 84 are driven by the same power source M3 through the clutch mechanisms C1 and C2, respectively. By using the clutch mechanisms C1 and C2, the rotational speed of the developing roller 52 and the rotational speed of the second transport member 84 may be changed independently of each other.

Figure 5B:
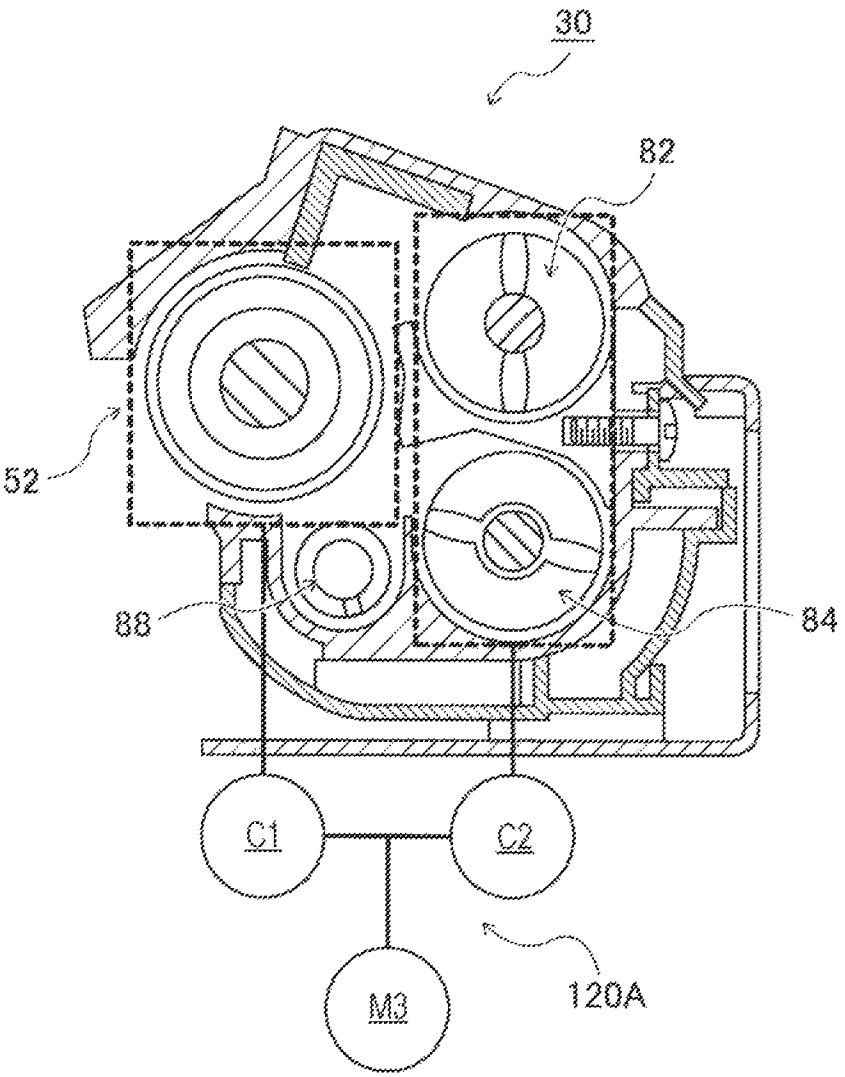
FIG. 5B illustrates another example of a method for driving the developing device according to the exemplary embodiment of the present disclosure.
Figure 5A:
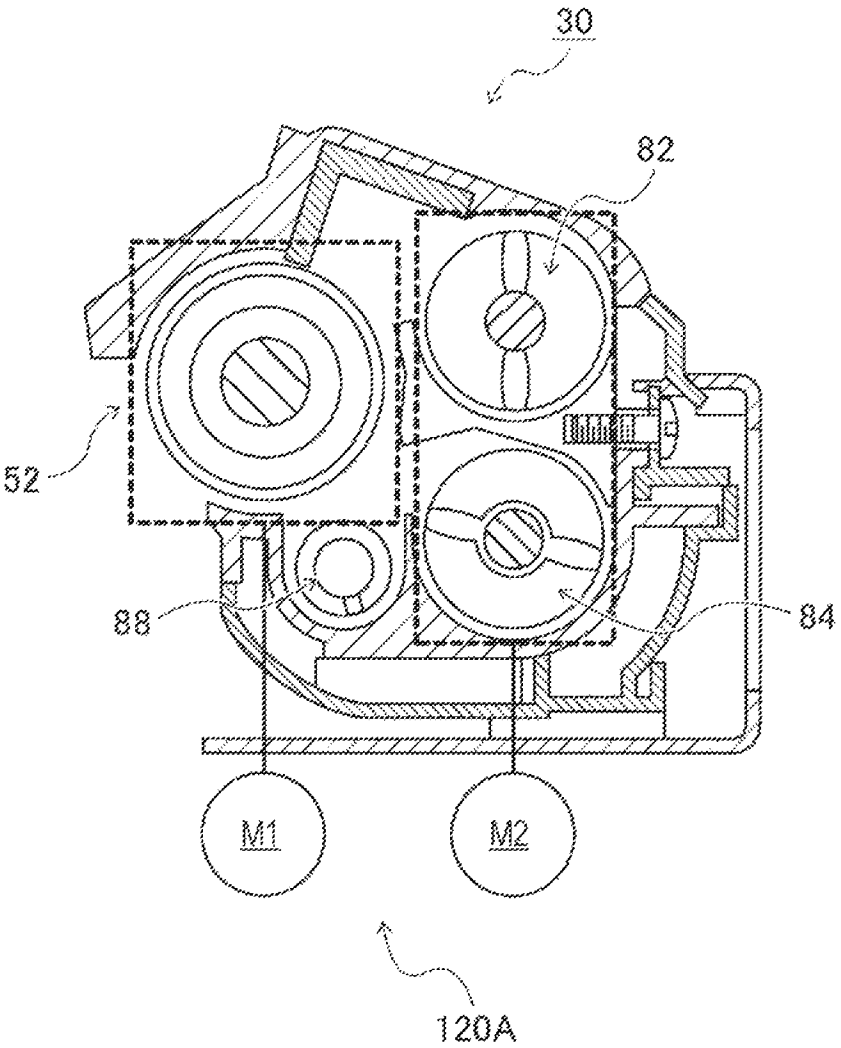
FIG. 5A illustrates another example of a method for driving the developing device according to the exemplary embodiment of the present disclosure.

FIGS. 5A and 5B illustrate another example of a method for driving the developing roller 52, the first transport member 82, the second transport member 84, and the third transport member 88 of the developing device 30 having the above-described structure. Similarly to FIG. 4A, a driving device 120A illustrated in FIG. 5A drives the developing roller 52 and the second transport member 84 by using different power sources M1 and M2. The first transport member 82 and the second transport member 84 are driven by the same power source M2. Therefore, the rotational speed ratio between the first transport member 82 and the second transport member 84 is constant. The rotational speed of the developing roller 52 driven by the first power source M1 and the combination of the rotational speeds of the first transport member 82 and the second transport member 84 driven by the second power source M2 are changeable independently of each other.

In FIG. 5B, the driving device 120A drives the developing roller 52, the first transport member 82, and the second transport member 84 by using the same power source M3 through clutch mechanisms C1 and C2. The clutch mechanism C1 is disposed between the power source M3 and the developing roller 52, and the clutch mechanism C2 is disposed between the power source M3 and each of the first transport member 82 and the second transport member 84. By using the clutch mechanisms C1 and C2, the rotational speed of the developing roller 52 and the combination of the rotational speeds of the first transport member 82 and the second transport member 84 may be changed independently of each other.

Figure 6B:
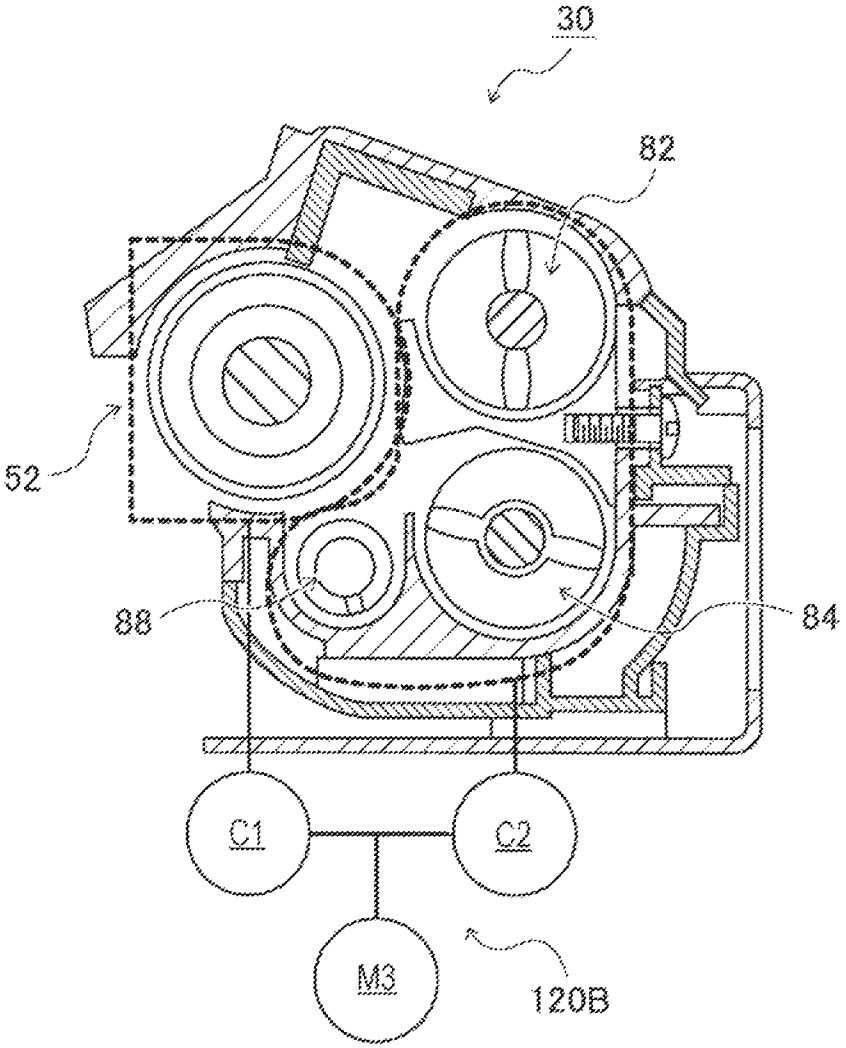
FIG. 6B illustrates another example of a method for driving the developing device according to the exemplary embodiment of the present disclosure.
Figure 6A:
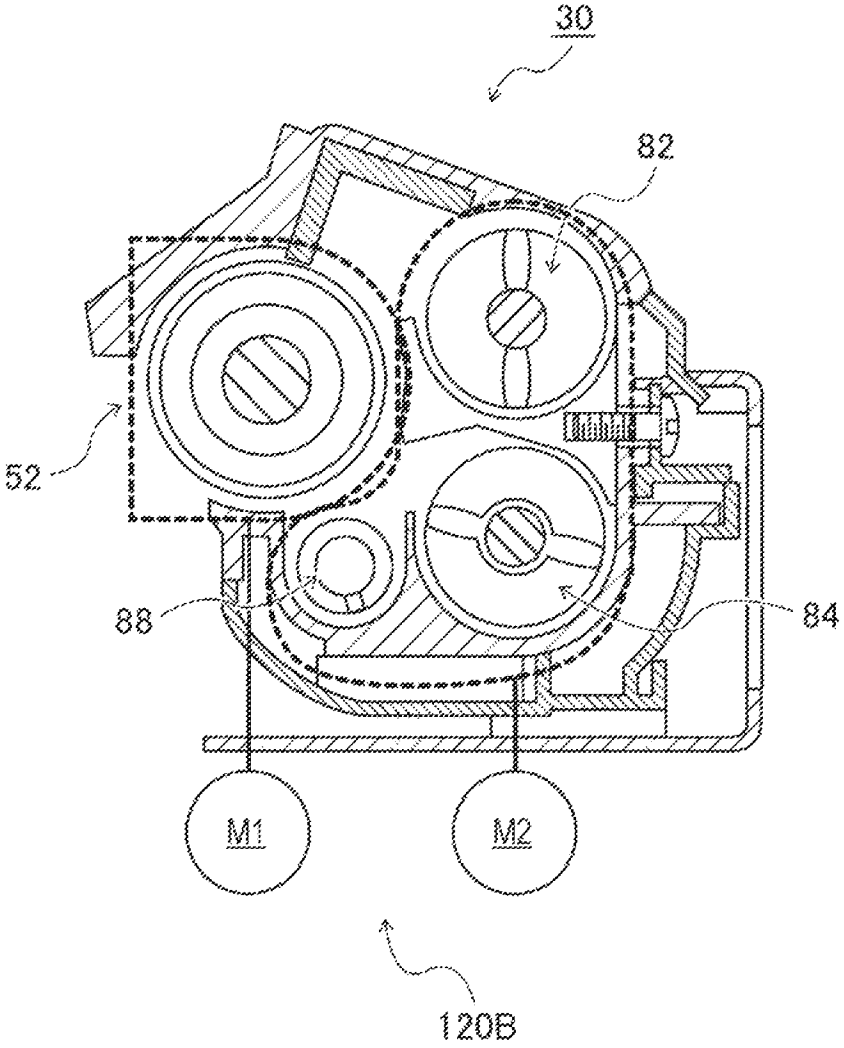
FIG. 6A illustrates another example of a method for driving the developing device according to the exemplary embodiment of the present disclosure.

FIGS. 6A and 6B illustrate another example of a method for driving the developing roller 52, the first transport member 82, the second transport member 84, and the third transport member 88 of the developing device 30 having the above-described structure. Similarly to FIG. 4A, a driving device 120B illustrated in FIG. 6A drives the developing roller 52 and the second transport member 84 by using different power sources M1 and M2. The first transport member 82, the second transport member 84, and the third transport member 88 are driven by the same power source M2. Therefore, the rotational speed ratio between the first transport member 82, the second transport member 84, and the third transport member 88 is constant. The rotational speed of the developing roller 52 driven by the first power source M1 and the combination of the rotational speeds of the first transport member 82, the second transport member 84, and the third transport member 88 driven by the second power source M2 are changeable independently of each other.

In FIG. 6B, the driving device 120B drives the developing roller 52, the first transport member 82, the second transport member 84, and the third transport member 88 by using the same power source M3 through clutch mechanisms C1 and C2. The clutch mechanism C1 is disposed between the power source M3 and the developing roller 52, and the clutch mechanism C2 is disposed between the power source M3 and each of the first transport member 82, the second transport member 84, and the third transport member 88. By using the clutch mechanisms C1 and C2, the rotational speed of the developing roller 52 and the combination of the rotational speeds of the first transport member 82, the second transport member 84, and the third transport member 88 may be changed independently of each other.

Figure 7B:
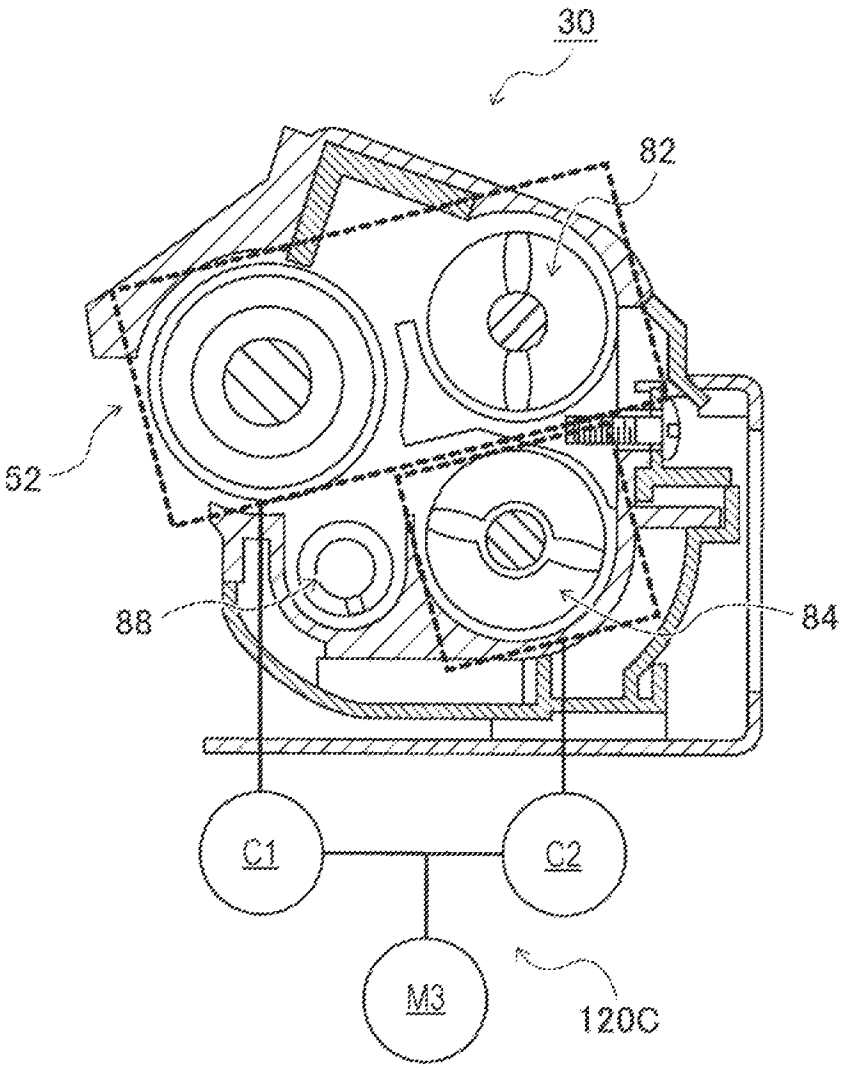
FIG. 7B illustrates another example of a method for driving the developing device according to the exemplary embodiment of the present disclosure.
Figure 7A:
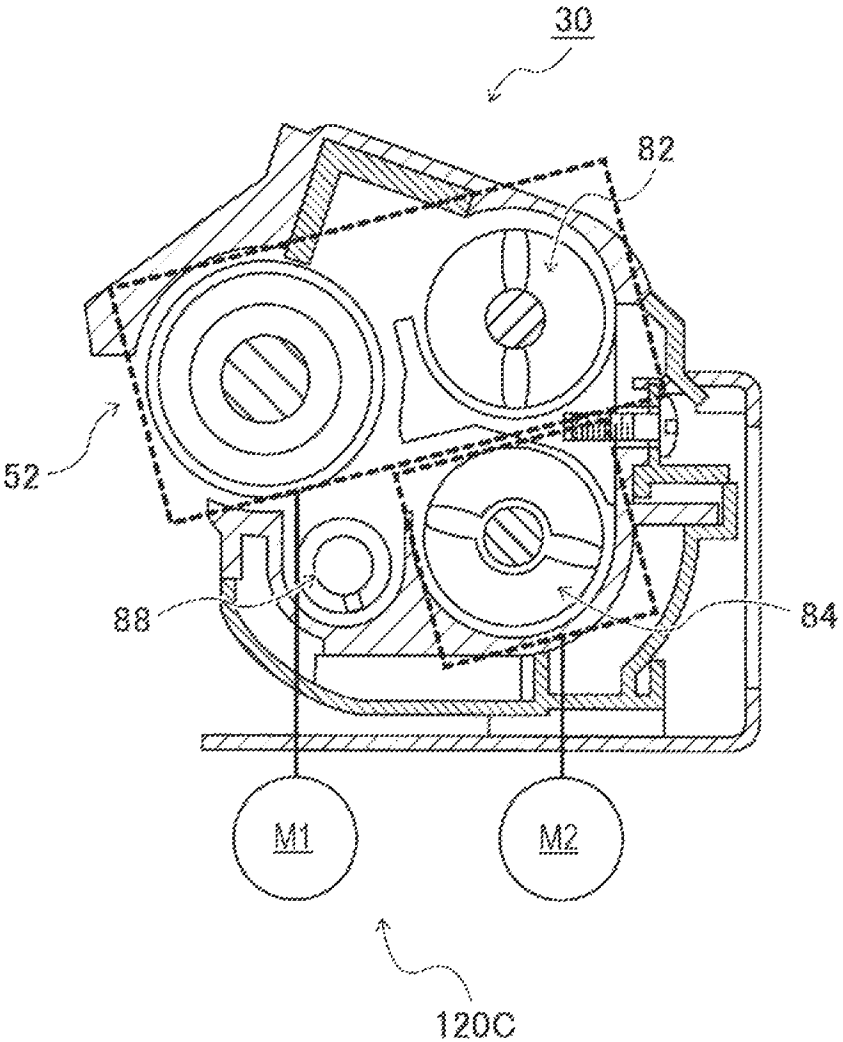
FIG. 7A illustrates another example of a method for driving the developing device according to the exemplary embodiment of the present disclosure.

FIGS. 7A and 7B illustrate another example of a method for driving the developing roller 52, the first transport member 82, the second transport member 84, and the third transport member 88 of the developing device 30 having the above-described structure. Similarly to FIG. 4A, a driving device 120C illustrated in FIG. 7A drives the developing roller 52 and the second transport member 84 by using different power sources M1 and M2. The developing roller 52 and the first transport member 82 are driven by the same power source M1. Therefore, the rotational speed ratio between the developing roller 52 and the first transport member 82 is constant. The combination of the rotational speeds of the developing roller 52 and the first transport member 82 driven by the first power source M1 and the rotational speed of the second transport member 84 driven by the second power source M2 are changeable independently of each other.

In FIG. 7B, the driving device 120C drives the developing roller 52, the first transport member 82, and the second transport member 84 by using the same power source M3 through clutch mechanisms C1 and C2. The clutch mechanism C1 is disposed between the power source M3 and each of the developing roller 52 and the first transport member 82, and the clutch mechanism C2 is disposed between the power source M3 and the second transport member 84. By using the clutch mechanisms C1 and C2, the combination of the rotational speeds of the developing roller 52 and the first transport member 82 and the rotational speed of the second transport member 84 may be changed independently of each other.

Figure 8B:
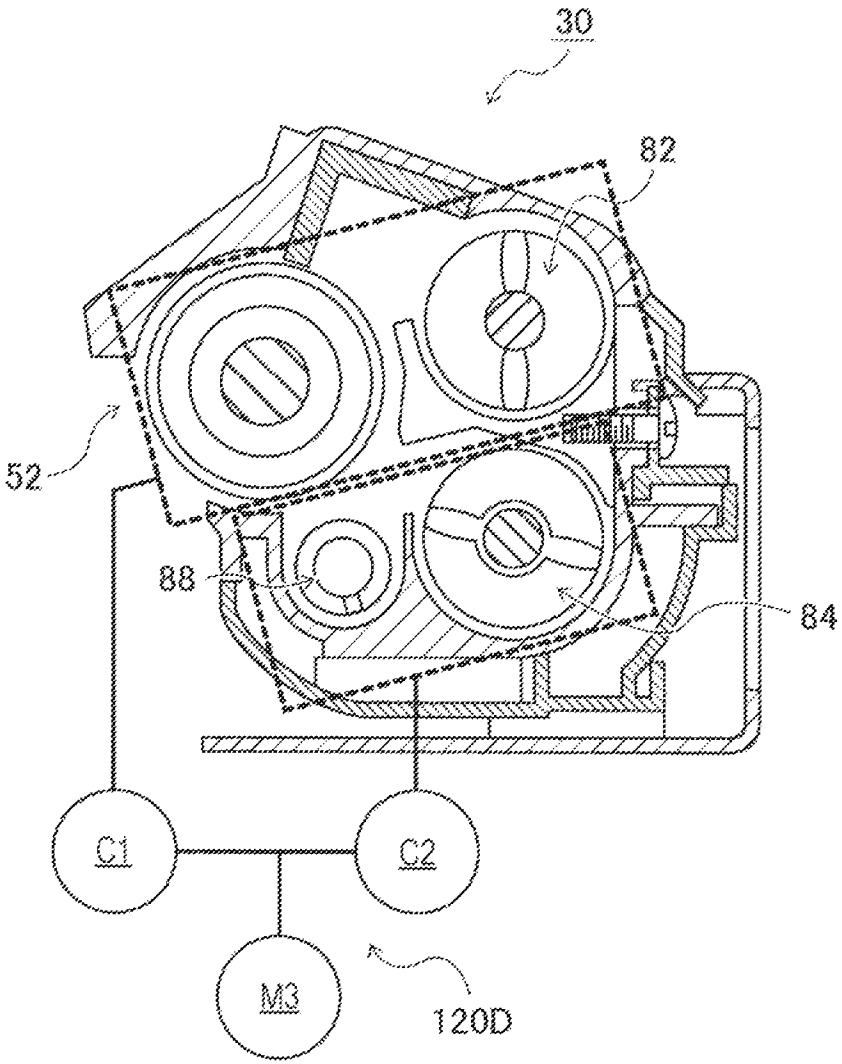
FIG. 8B illustrates another example of a method for driving the developing device according to the exemplary embodiment of the present disclosure.
Figure 8A:
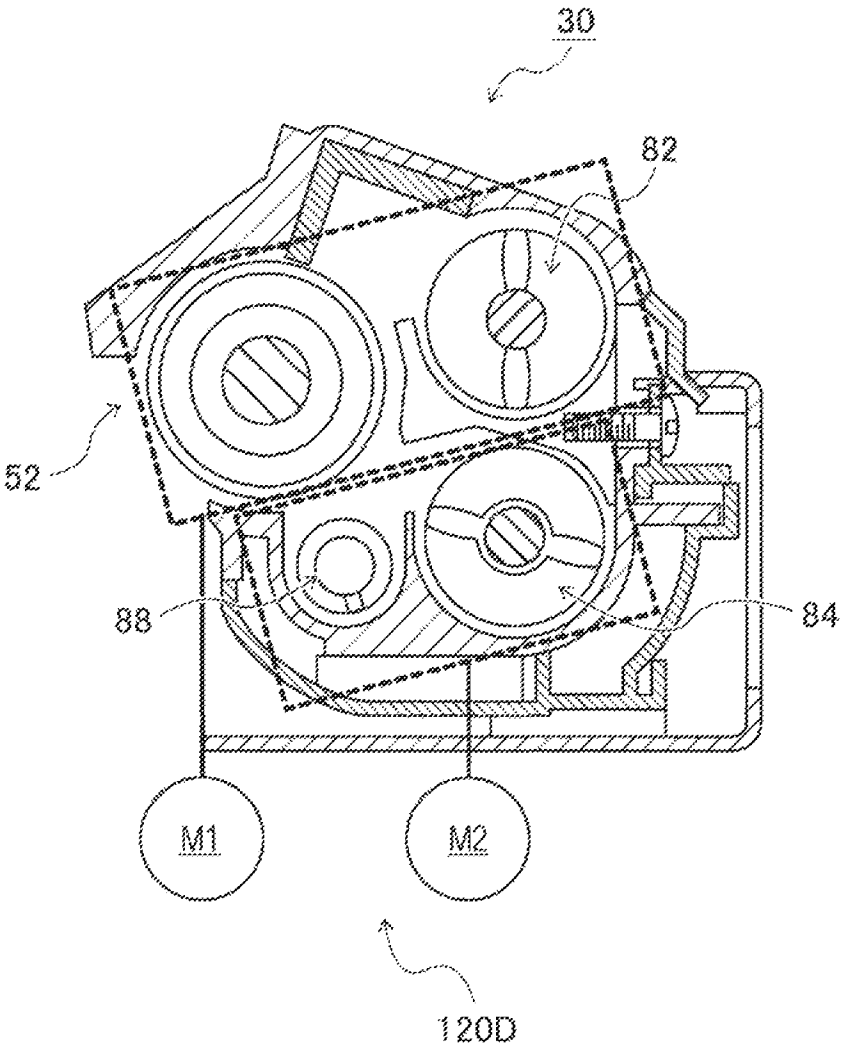
FIG. 8A illustrates another example of a method for driving the developing device according to the exemplary embodiment of the present disclosure.

FIGS. 8A and 8B illustrate another example of a method for driving the developing roller 52, the first transport member 82, the second transport member 84, and the third transport member 88 of the developing device 30 having the above-described structure. Similarly to FIG. 4A, a driving device 120D illustrated in FIG. 8A drives the developing roller 52 and the second transport member 84 by using different power sources M1 and M2. The developing roller 52 and the first transport member 82 are driven by the same power source M1. The second transport member 84 and the third transport member 88 are driven by the same power source M2. Therefore, the rotational speed ratio between the developing roller 52 and the first transport member 82 is constant, and the rotational speed ratio between the second transport member 84 and the third transport member 88 is also constant. The combination of the rotational speeds of the developing roller 52 and the first transport member 82 driven by the first power source M1 and the combination of the rotational speeds of the second transport member 84 and the third transport member 88 driven by the second power source M2 are changeable independently of each other.

In FIG. 8B, the driving device 120D drives the developing roller 52, the first transport member 82, the second transport member 84, and the third transport member 88 by using the same power source M3 through clutch mechanisms C1 and C2. The clutch mechanism C1 is disposed between the power source M3 and each of the developing roller 52 and the first transport member 82, and the clutch mechanism C2 is disposed between the power source M3 and each of the second transport member 84 and the third transport member 88. By using the clutch mechanisms C1 and C2, the combination of the rotational speeds of the developing roller 52 and the first transport member 82 and the combination of the rotational speeds of the second transport member 84 and the third transport member 88 may be changed independently of each other.

Figure 9B:
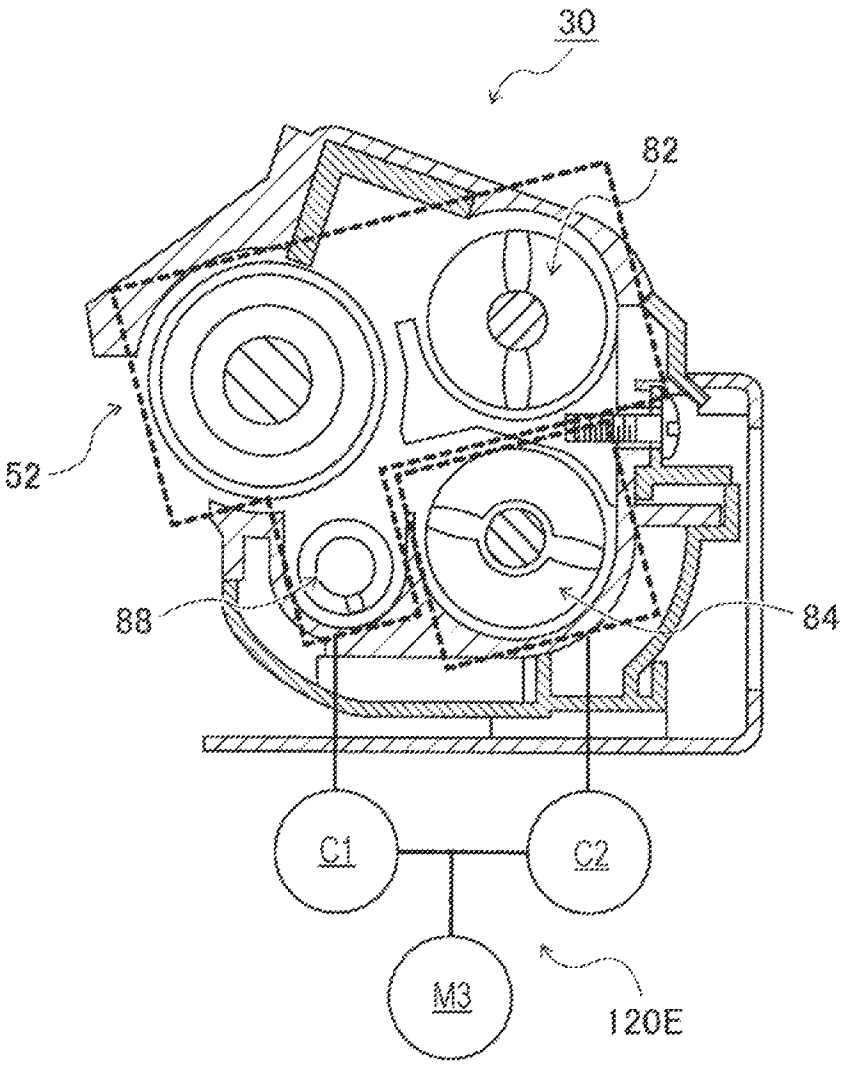
FIG. 9B illustrates another example of a method for driving the developing device according to the exemplary embodiment of the present disclosure.
Figure 9A:
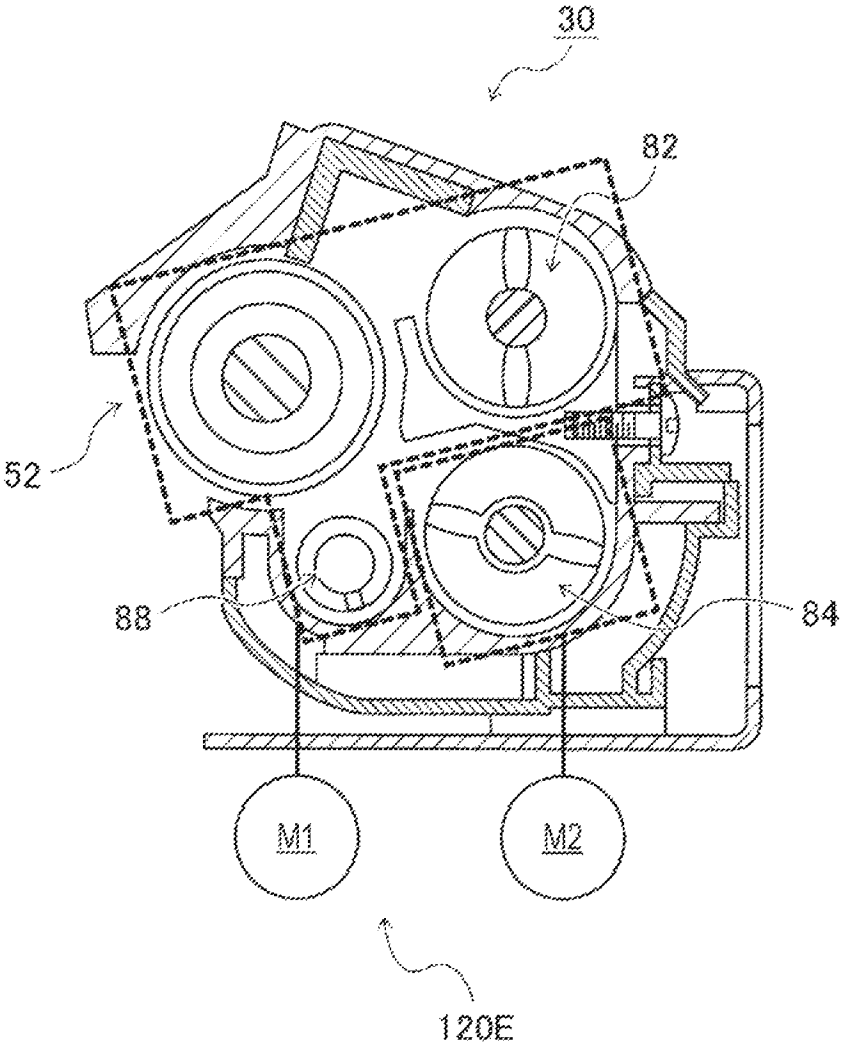
FIG. 9A illustrates another example of a method for driving the developing device according to the exemplary embodiment of the present disclosure.

FIGS. 9A and 9B illustrate another example of a method for driving the developing roller 52, the first transport member 82, the second transport member 84, and the third transport member 88 of the developing device 30 having the above-described structure. Similarly to FIG. 4A, a driving device 120E illustrated in FIG. 9A drives the developing roller 52 and the second transport member 84 by using different power sources M1 and M2. The developing roller 52, the first transport member 82, and the third transport member 88 are driven by the same power source M1, and only the second transport member 84 is driven by the other power source M2. Therefore, the rotational speed ratio between the developing roller 52, the first transport member 82, and the third transport member 88 is constant. The combination of the rotational speeds of the developing roller 52, the first transport member 82, and the third transport member 88 driven by the first power source M1 and the rotational speed of the second transport member 84 driven by the second power source M2 are changeable independently of each other.

In FIG. 9B, the driving device 120E drives the developing roller 52, the first transport member 82, the second transport member 84, and the third transport member 88 by using the same power source M3 through clutch mechanisms C1 and C2. The clutch mechanism C1 is disposed between the power source M3 and each of the developing roller 52, the first transport member 82, and the third transport member 88, and the clutch mechanism C2 is disposed between the power source M3 and the second transport member 84. By using the clutch mechanisms C1 and C2, the combination of the rotational speeds of the developing roller 52, the first transport member 82, and the third transport member 88 and the rotational speed of the second transport member 84 may be changed independently of each other.

Figure 10B:
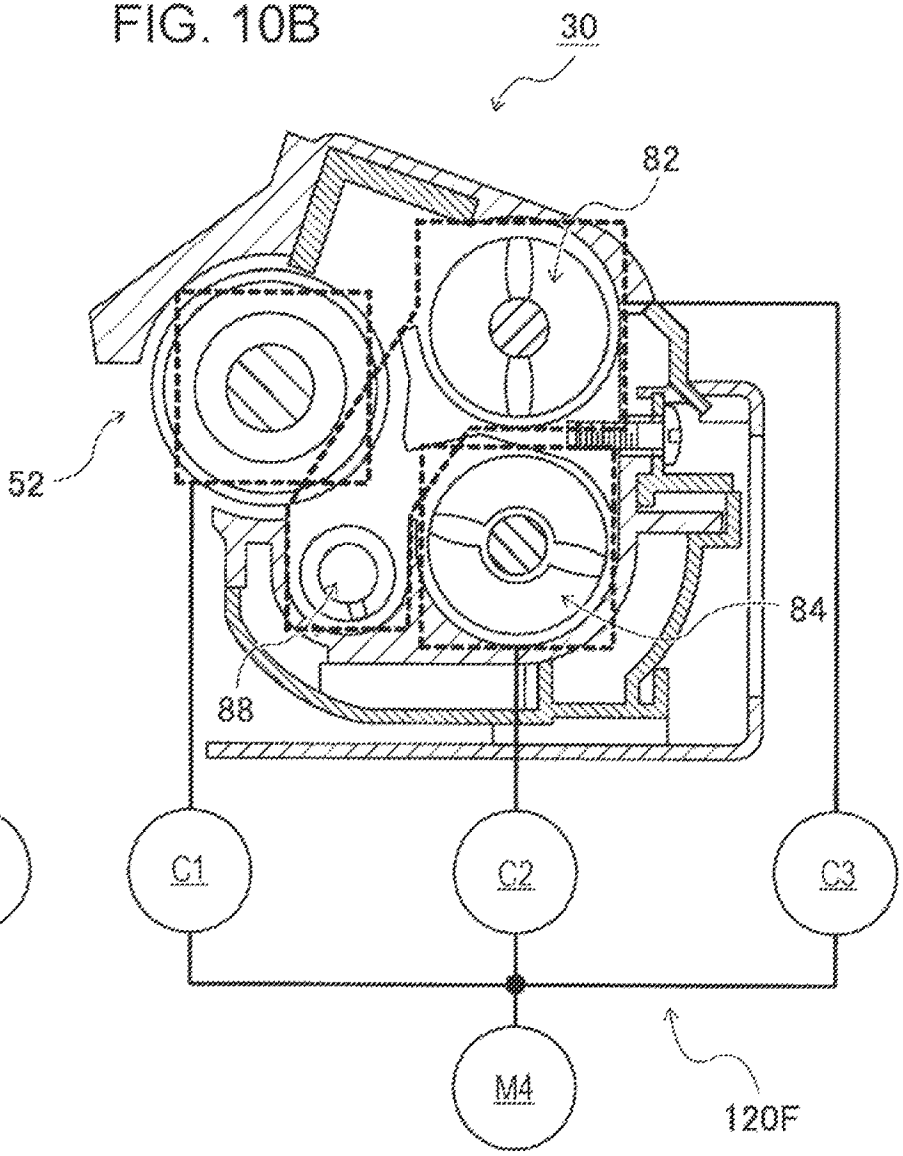
FIG. 10B illustrates another example of a method for driving the developing device according to the exemplary embodiment of the present disclosure.
Figure 10A:
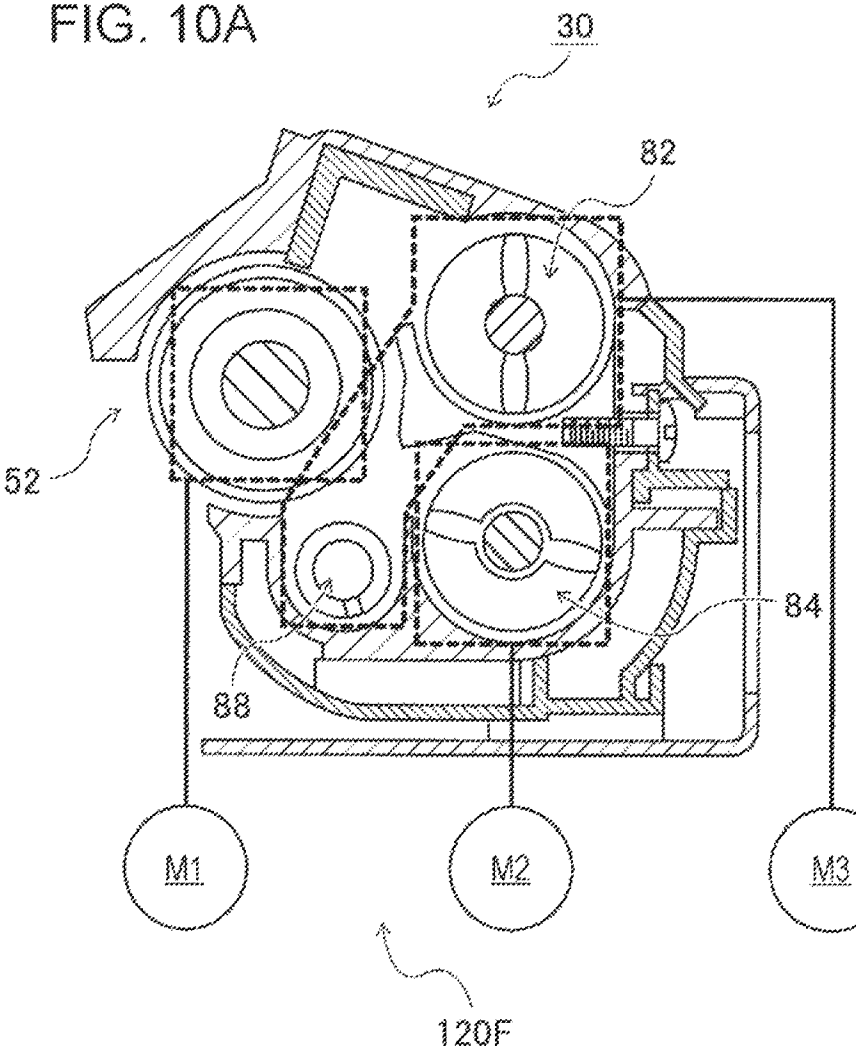
FIG. 10A illustrates another example of a method for driving the developing device according to the exemplary embodiment of the present disclosure.

FIGS. 10A and 10B illustrate another example of a method for driving the developing roller 52, the first transport member 82, the second transport member 84, and the third transport member 88 of the developing device 30 having the above-described structure. Similarly to FIG. 4A, a driving device 120F illustrated in FIG. 10A drives the developing roller 52 and the second transport member 84 by using different power sources M1 and M2. The first transport member 82 and the third transport member 88 are driven by the same power source M3. Therefore, the rotational speed ratio between the first transport member 82 and the third transport member 88 is constant. The rotational speed of the developing roller 52 driven by the first power source M1, the rotational speed of the second transport member 84 driven by the second power source M2, and the combination of the rotational speeds of the first transport member 82 and the third transport member 88 driven by the third power source M3 are changeable independently of each other.

In FIG. 10B, the driving device 120F drives the developing roller 52, the first transport member 82, the second transport member 84, and the third transport member 88 by using the same power source M4 through clutch mechanisms C1, C2, and C3. The clutch mechanism C1 is disposed between the power source M4 and the developing roller 52, and the clutch mechanism C2 is disposed between the power source M4 and the second transport member 84. The clutch mechanism C3 is disposed between the power source M4 and each of the first transport member 82 and the third transport member 88. By using the clutch mechanisms C1, C2, and C3, the rotational speed of the developing roller 52, the rotational speed of the second transport member 84, and the combination of the rotational speeds of the first transport member 82 and the third transport member 88 may be changed independently of each other.

The first power source M1, the second power source M2, the third power source M3, and the power source M4 each include a stepping motor (not illustrated) and a gear mechanism (not illustrated) for adjusting the rotational speeds, and are controlled and driven by a control device (not illustrated) that is disposed in the image-forming-apparatus body 12 and that controls the operation of each part of the image forming apparatus 10. The control device includes a CPU, a memory, a storage device, and a communication interface (not illustrated). The CPU is a control microprocessor that controls the operation of each part of the image forming apparatus based on control programs stored in the storage device.

In the embodiments described above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

The operation performed by the processor according to the above-described exemplary embodiment may be performed by one processor or plural processors in collaboration which are located physically apart from each other but may work cooperatively. The order of operations of the processor is not limited to one described in the embodiments above, and may be changed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a first transport member and a second transport member that are respectively disposed in a first transport path and a second transport path arranged in a vertical direction and that transport developer so as to circulate the developer between the first transport path and the second transport path;

a developing member that is disposed to face the first transport path and that receives the developer from the first transport path; and a driving device that operates such that a relative speed ratio between a rotational speed of the first transport member and a rotational speed of the second transport member is changeable.

2. The developing device according to claim 1, wherein the driving device drives the first transport member and the second transport member by using different power sources.

3. The developing device according to claim 2, further comprising:

a third transport member that is disposed in a third transport path and that collects and transports the developer that has not been used by the developing member to the second transport path, wherein the driving device operates such that a relative speed ratio between a rotational speed of the first transport member and a rotational speed of the third transport member is constant.

4. The developing device according to claim 2, further comprising:

a third transport member that is disposed in a third transport path and that collects and transports the developer that has not been used by the developing member to the second transport path; and a partitioning member disposed between the second transport path and the third transport path, the partitioning member having a predetermined height.

5. The developing device according to claim 1, further comprising:

a third transport member that is disposed in a third transport path and that collects and transports the developer that has not been used by the developing member to the second transport path; and a partitioning member disposed between the second transport path and the third transport path, the partitioning member having a predetermined height.

6. An image forming apparatus comprising:

the developing device according to claim 1; and a latent image carrier disposed to face the developing device.

7. A developing device comprising:

a first transport member and a second transport member that are respectively disposed in a first transport path and a second transport path arranged in a vertical direction and that transport developer so as to circulate the developer between the first transport path and the second transport path;

a developing member that is disposed to face the first transport path and that receives the developer from the first transport path; and a driving device that operates such that a relative speed ratio between a rotational speed of the developing member and a rotational speed of the second transport member is changeable, wherein the driving device includes a clutch mechanism, and the clutch mechanism changes the relative speed ratio between the rotational speed of the developing member and the rotational speed of the second transport member.

8. The developing device according to claim 7, wherein the driving device operates such that a relative speed ratio between a rotational speed of the first transport member and the rotational speed of the second transport member is constant.

9. The developing device according to claim 8, further comprising:

a third transport member that is disposed in a third transport path and that collects and transports the developer that has not been used by the developing member to the second transport path, wherein the driving device operates such that a relative speed ratio between the rotational speed of the first transport member, the rotational speed of the second transport member, and a rotational speed of the third transport member is constant.

10. The developing device according to claim 9, wherein the driving device operates such that a relative speed ratio between the rotational speed of the developing member and a rotational speed of the first transport member is constant.

11. The developing device according to claim 10, further comprising:

a third transport member that is disposed in a third transport path and that collects and transports the developer that has not been used by the developing member to the second transport path, wherein the driving device operates such that a relative speed ratio between the rotational speed of the second transport member and a rotational speed of the third transport member is constant.

12. The developing device according to claim 10, further comprising:

a third transport member that is disposed in a third transport path and that collects and transports the developer that has not been used by the developing member to the second transport path, wherein the driving device operates such that a relative speed ratio between the rotational speed of the developing member, the rotational speed of the first transport member, and a rotational speed of the third transport member is constant.

13. The developing device according to claim 7, further comprising:

a third transport member that is disposed in a third transport path and that collects and transports the developer that has not been used by the developing member to the second transport path, wherein the driving device operates such that a relative speed ratio between a rotational speed of the first transport member and a rotational speed of the third transport member is constant.

14. The developing device according to claim 7, further comprising:

a third transport member that is disposed in a third transport path and that collects and transports the developer that has not been used by the developing member to the second transport path; and a partitioning member disposed between the second transport path and the third transport path, the partitioning member having a predetermined height.

15. A developing device comprising:

a first transport member and a second transport member that are respectively disposed in a first transport path and a second transport path arranged in a vertical direction and that transport developer so as to circulate the developer between the first transport path and the second transport path;

a developing member that is disposed to face the first transport path and that receives the developer from the first transport path; and a driving device that operates such that a relative speed ratio between a rotational speed of the developing member and a rotational speed of the second transport member is changeable, wherein the driving device operates such that a relative speed ratio between the rotational speed of the developing member and a rotational speed of the first transport member is always constant.

16. The developing device according to claim 15, further comprising:

a third transport member that is disposed in a third transport path and that collects and transports the developer that has not been used by the developing member to the second transport path, wherein the driving device operates such that a relative speed ratio between the rotational speed of the second transport member and a rotational speed of the third transport member is constant.

17. The developing device according to claim 15, further comprising:

a third transport member that is disposed in a third transport path and that collects and transports the developer that has not been used by the developing member to the second transport path, wherein the driving device operates such that a relative speed ratio between the rotational speed of the developing member, the rotational speed of the first transport member, and a rotational speed of the third transport member is constant.

* * * * *